United States Patent [19]

Kraus

[11] Patent Number: 4,788,737

[45] Date of Patent: Dec. 6, 1988

[54] ADJUSTABLE BRUSH GLIDER

[75] Inventor: Eugene F. Kraus, Monticello, Minn.

[73] Assignee: Flo-Pac Corporation, Minneapolis, Minn.

[21] Appl. No.: 175,147

[22] Filed: Mar. 30, 1988

[51] Int. Cl.[4] ..... A47L 11/164

[52] U.S. Cl. ..... 15/257 R; 15/49 R; 15/180

[58] Field of Search ..... 15/49 R, 50 R, 98, 257, 15/385, 180

[56] References Cited

U.S. PATENT DOCUMENTS

| | | | |
|---|---|---|---|
| 1,547,188 | 7/1925 | Wilson . | |
| 1,643,092 | 9/1927 | Shekerjian . | |
| 1,755,052 | 4/1930 | Chester . | |
| 2,320,545 | 6/1943 | Ross . | |
| 2,730,753 | 1/1956 | Gerber . | |
| 3,107,378 | 10/1963 | Jepson et al. | 15/49 R |
| 3,277,507 | 10/1966 | Sassano, Sr. | 15/50 R |
| 3,678,529 | 7/1972 | Woods . | |
| 3,780,407 | 12/1973 | Hoffecker . | |

*Primary Examiner*—Edward L. Roberts

*Attorney, Agent, or Firm*—James R. Haller; Gregory P. Kaihoi

[57] ABSTRACT

An adjustable brush glider mountable to a brush block to provide a surface for supporting the brush block a selected distance away from a floor. Complimentary inclined spacers are carried respectively by the brush glider and the brush block. One of the spacers is rotatable with respect to the other to selectively alter the spacing of the brush glider from the brush block.

9 Claims, 2 Drawing Sheets

ADJUSTABLE BRUSH GLIDER

FIELD OF THE INVENTION

The invention relates to rotary scrubbing brushes, and more particularly to a rotary scrubbing brush having a height adjustment means.

BACKGROUND OF THE INVENTION

Rotary scrubbing brushes employed with rotary scrubbing machines are used extensively for scrubbing, waxing, polishing, and shampooing various types of flooring. Both natural and synthetic fibers commonly are utilized in manufacturing the tufts of such brushes.

Typically, each type of fiber employed in the construction of brushes has certain shortcomings. For example, natural fibers can be adversely affected by certain cleaning chemicals which cause the fibers to rapidly deteriorate under constant use. Synthetic fibers, on the other hand, can resist the effects of cleaning fluids to a greater extent than some natural fibers. When used with a hot cleaning fluid, however, the synthetic bristles are softened and tend to flex significantly under even moderate pressure from a surface. Repeated flexing causes the bristles to fatigue, leading to premature bristle failure. Such bending of the bristles also reduces the scrubbing effectiveness of the brush.

SUMMARY OF THE INVENTION

The invention provides an adjustable brush glider for attachment to a rotary scrubbing brush comprising a glide member having a gliding surface, an adjustment means, and an attachment means enabling the device to be attached to a rotary scrubbing brush. The device provides an adjustable gliding surface which may be selectively spaced from the brush block to adjustably control the contact between the bristles and the floor.

DETAILED DESCRIPTION OF THE PREFERRED EMBODIMENT

Figure 1:
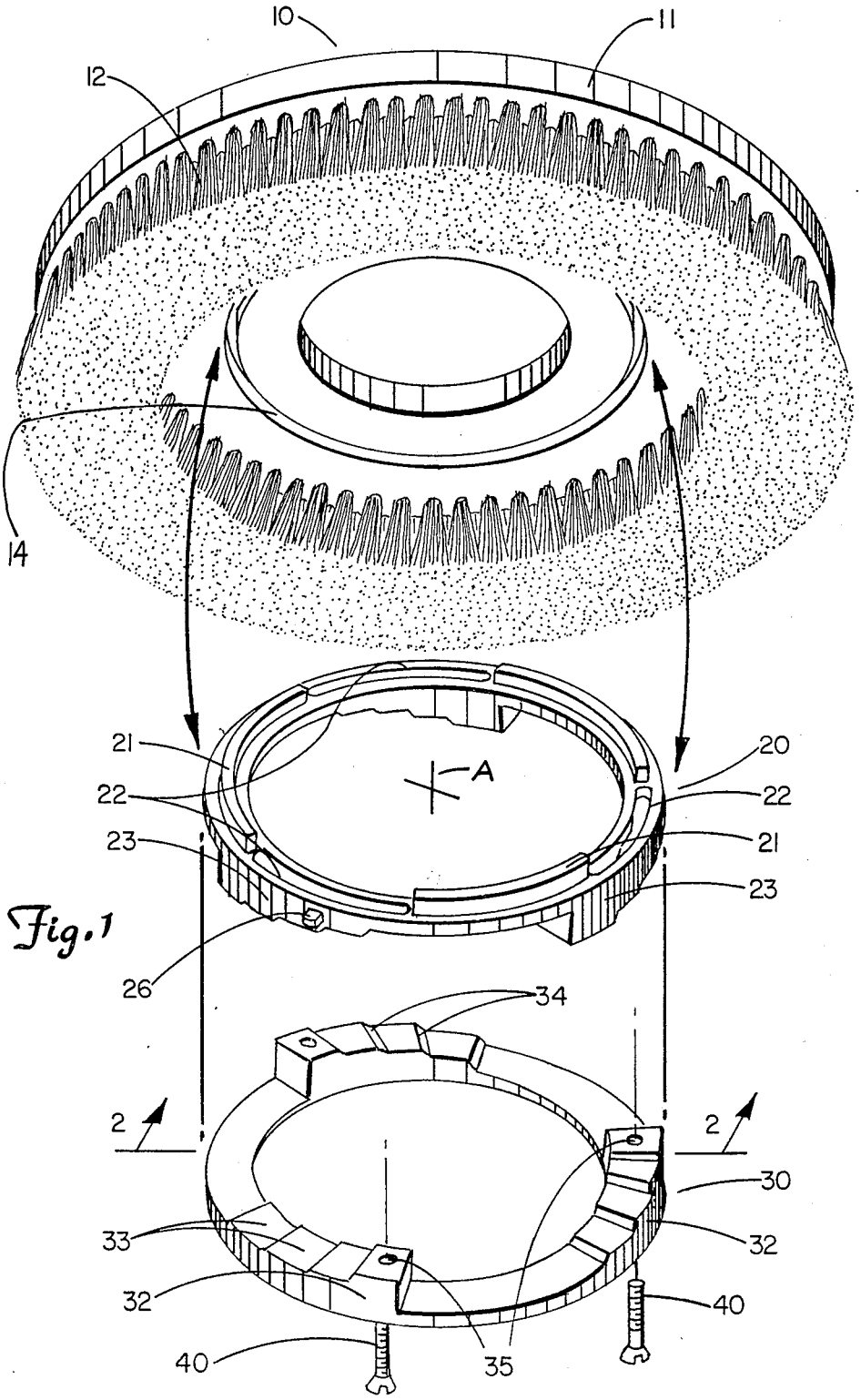
FIG. 1 is an exploded perspective view of the brush glider of the invention.

Referring to the drawings, FIG. 1 illustrates the components of the adjustable brush glider and shows their arrangement with respect to a brush. The rotary scrubbing brush (10) includes a disk-shaped block (11) formed of e.g., laminated plywood or other suitable materials, which is operatively mountable to a scrubbing machine or the like. Carried by the lower portion of the brush block (11) and extending generally downwardly therefrom are a plurality of concentrically arranged tufts of scrubbing bristles (12). The tufts are received within and retained by a plurality of openings carried by the lower portion of the brush block (11). The bristles (12) are formed of nylon or other suitable synthetic or natural fibers.

Gliding means is provided having a surface, spaced downwardly from the brush block (11), for contacting the floor to control the degree of contact between the bristles (12) of the brush (10) and the floor. Preferably the gliding means comprises a generally flat disk (30) formed of plastic, nylon, or other suitable material. The disk (30) provides a generally flat gliding surface (31) to space the brush blocks from the floor, thereby controlling the degree of contact between the bristles and the floor.

Adjustment means is provided for selectively spacing the gliding disk (30) from the brush block (11), thereby adjusting the distance from the brush block to the floor. Judicious adjustment of this distance permits control over the amount of flexing of the bristles independent, to a degree, of the weight applied to the brush or the relative softness of the bristles.

The adjustment means preferably includes an adjustment ring (20) carried between the gliding disk (30) and the brush block (11). The adjustment ring (20) may be formed of a rigid plastic or other suitable material and desirably is circular with an inner and an outer diameter as shown in FIG. 1. Carried upon the upper surface of the ring (20) is means for radially locating the ring (20) comprising a plurality of axially extending protrusions (21). These protrusions (21) are slidably received within a circular channel (14) recessed into the lower portion of the brush block (11) enabling the ring (20) to be carried coaxially upon the rotated freely with respect to the brush block (11). A plurality of curved channel openings (22) extend generally vertically through a portion of the ring (20), curved generally in alignment with the curvature of the ring (20), for slidably receiving attachment means, such as bolts (40), therethrough.

Carried upon the lower surface of the ring (20) are a plurality of angularly spaced inclined spacers preferably configured as ascending staircase portions (23), each staircase providing a plurality of generally horizontal stair step surfaces (24) for adjusting the axial spacing of the gliding disk (30) with respect to the brush block (11). The stair step portions (23) are designed to closely engage complimentary stair step portions (32) carried upon the upper surface of the gliding disk (30).

The stair-step portions (23,32) are rotatable with respect to one another to selectively alter the spacing of the glide surface (31) from the brush block (11). In a preferred embodiment the ring (20) is rotatable while the disk (30) is rotably fixed with respect to the brush block. Alternately the disk (30) may be rotatable and the ring (20) so fixed.

One or more generally rounded protrusions (26) (preferably two) are carried on the peripheral edge of the rotatable part—in FIG. 1, the ring (20)—to facilitate manually grasping and rotating it with respect to the brush block (11). Preferably the protrusions (26) are positioned generally equiangularly with respect to each other to facilitate this manipulation. Rotation of the ring (20) with respect to the disk (30) is facilitated by camming surfaces (25,34) carried adjacent the stair-steps (24,33) of the adjustment ring (20) and the disk (30).

Figure 2:
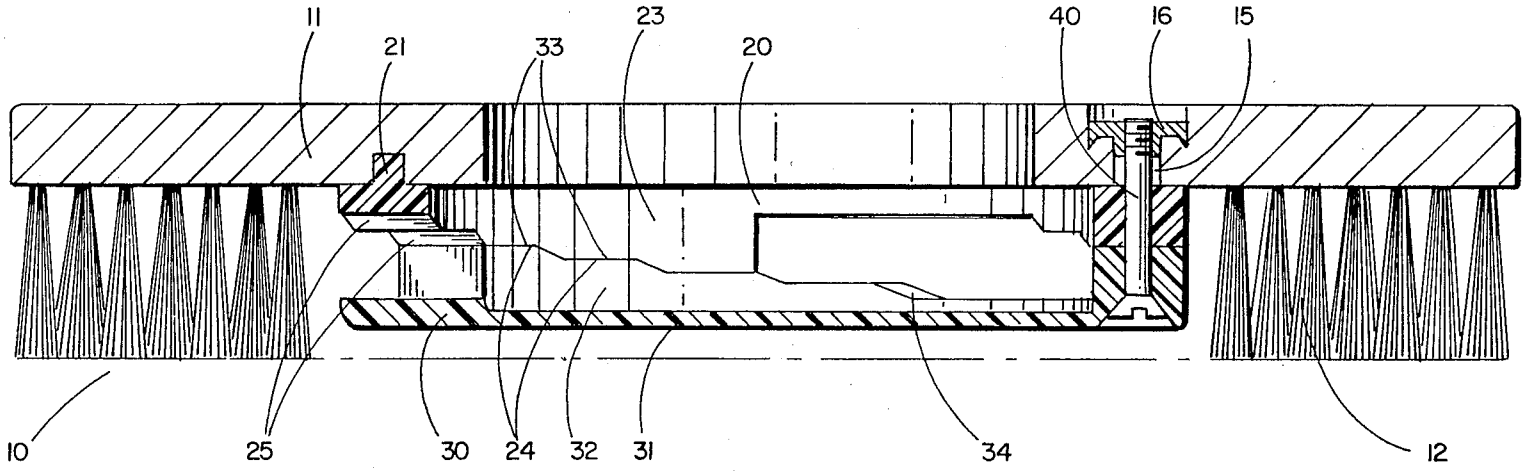
FIG. 2 is a cross-sectional view of the brush glider of FIG. 1 taken along line 2—2 thereof.

The brush glider of the invention is removably attached to the brush block (11) through any suitable means, preferably a plurality of threaded bolts (40) which are loosely received through openings (35) in the gliding disk (30) and the channels (22) in the ring (20). The bolts are threadingly received in the openings (15) in the brush block (11). The openings (15) in the brush block may include threaded bolt anchoring portions (16) as shown in FIG. 2. The bolts (40) secure and retain the gliding disk (30) and, when tightened, effectively prevent the ring (20) from moving with respect to the brush block (11).

In operation, the mounting bolts (40) are first loosened adequately to permit the gliding disk (30) to be moved axially a desired distance away from the brush block (11). The protrusions (26) located on the periphery of the adjustment ring (20) then are manually grasped. Rotation of the adjustment ring (20) in the proper direction will cause the camming surfaces (25) carried by the stair case portions (23) of the ring (20) to engage the camming surfaces (34) carried by the stair step portions (32) of the disk (30), causing the stair-steps of the respective portions to engage one another on the next adjacent step. Such rotation will move the gliding surface (31) axially away from the brush block (11).

If greater contact of the bristles with the floor is desired, rotation of the adjustment ring (20) in the opposite direction will cause the gliding surface (31) to move closer to the brush block (11). The adjustment ring (20) is rotated until a desired glider surface (31) to brush block (11) distance is obtained. When the device is located in the desired position with minimal space between the camming surfaces (24,34), the mounting bolts (40) are firmly tightened, preventing further rotation of the ring (20).

While a preferred embodiment of the present invention has been described, it should be understood that various changes, adaptations and modifications may be made therein without departing from the spirit of the invention and the scope of the appended claims.

What is claimed is:

1. An adjustable brush glider for attachment to a rotary scrubbing brush of the type having tufts depending from a brush block, comprising:

a glide member having a gliding surface;

adjustment means for mounting the glide member to the brush block and enabling adjustment of the glide member to selectively space the glide surface from the brush block, the adjustment means including complimentary inclined spacers carried respectively by the glide member and the brush, one of the spacers being rotatable with respect to the other to selectively alter the spacing of the glide surface from the brush block; and attachment means for removably coupling the glide member to the brush block.

2. The adjustable brush glider of claim 1 wherein the inclined spacers include complimentary stair-step portions.

3. The adjustable brush glider of claim 2 wherein the stair-step portions include complimentary camming surfaces carried adjacent each stair-step for sliding engagement to facilitate rotational movement of the stair-steps with respect to one another.

4. The adjustable brush glider of claim 1 wherein the inclined spacer carried by the brush block is rotatable with respect to the brush block and the glide member.

5. The adjustable brush glider of claim 4 wherein the brush block inclined spacer is generally ring-shaped, and includes a plurality of axial projections receivable in a complimentary groove in the brush block, the projections permitting rotational movement of the ring with respect to the brush block.

6. The adjustable brush glider of claim 4 wherein the brush block inclined spacer is generally ring-shaped and includes a plurality of stair-step portions generally equiangularly spaced about the ring.

7. The adjustable brush glider of claim 1 wherein the glide surface is circular.

8. The adjustable brush glider of claim 1 wherein said attachment means comprises a plurality of bolts which are received through openings in the glide member and threadingly received in the brush block.

9. An adjustable brush glider for attachment to a rotary scrubbing brush of the type having tufts depending from a brush block, comprising:

a glide member having a generally circular, planar gliding surface;

adjustment means for enabling adjustment of the glide member to selectively space the gliding surface from the brush block, the adjustment means including a plurality of stair-step portions carried by the glide member and a ring-shaped inclined spacer having complimentary stair-step portions which engage and cooperate with corresponding stair-step portions carried by the glide member, the spacer being rotatable with respect to the brush block and the glide member, the stair-step portions including complimentary camming surfaces carried adjacent each stair-step for sliding engagement to facilitate rotational movement of the stair-steps with respect to one another, the inclined spacer including a plurality of axial projections receivable in a complimentary groove in the brush block to permit rotational movement of the spacer with respect to the brush block; and attachment means for removably coupling the glide member to the brush block including a plurality of bolts which are received through openings in the glide member and threadlingly received in openings in the brush block.

* * * * *

UNITED STATES PATENT AND TRADEMARK OFFICE

CERTIFICATE OF CORRECTION

PATENT NO. : 4,788,737

DATED : Dec. 6, 1988

INVENTOR(S) : Eugene F. Kraus

It is certified that error appears in the above—identified patent and that said Letters Patent is hereby corrected as shown below:

Column 2, line 21, delete "the" and insert --and--.

Column 3, line 38, after the word "brush", insert --block--.

Signed and Sealed this

Third Day of October, 1989

*Attest:*

*Attesting Officer*

DONALD J. QUIGG

*Commissioner of Patents and Trademarks*